United States Patent [19]

Megerle et al.

[11] 4,170,344

[45] Oct. 9, 1979

[54] APPARATUS FOR THE SEPARATION OF A MIXTURE OF COMPONENTS, PARTICULARLY MOLTEN METALS, METAL COMPOUNDS AND/OR METAL CONTAINING SLAGS IN A CENTRIFUGAL FORCE FIELD

[75] Inventors: Friedrich Megerle; Alfred Kryczun; Willy Jakobs, all of Cologne, Fed. Rep. of Germany

[73] Assignee: Klöckner-Humbolt-Deutz AG, Fed. Rep. of Germany

[21] Appl. No.: 874,496

[22] Filed: Feb. 2, 1978

[30] Foreign Application Priority Data

Feb. 23, 1977 [DE] Fed. Rep. of Germany ..... 2707726

[51] Int. Cl.[2] ..... C22B 9/02

[52] U.S. Cl. ..... 266/204

[58] Field of Search ..... 75/61, 93 R; 233/11, 233/3, 27, 1 E; 266/204, 227

[56] References Cited

U.S. PATENT DOCUMENTS 980,001 12/1910 Ponten ..... 233/3

2,415,210 2/1947 Hoefling ..... 233/27

4,033,563 7/1977 Jakobs et al. ..... 266/204

*Primary Examiner*—Gerald A. Dost

*Attorney, Agent, or Firm*—Hill, Van Santen, Steadman, Chiara & Simpson

[57] ABSTRACT

An apparatus for the separation of components such as molten metals, compounds or metal containing slags centrifugally including a centrifugal body universally suspended including a hollow shaft with a concentric inlet opening at the bottom to be submerged beneath the surface of a liquid to be separated with the larger basket portion surrounding an upper portion of the shaft radially communicating openings and dual layered annular cooling sleeves surrounding the pipe and basket with means for conducting a cooling fluid therethrough and the fluid picking up heat in the submerged area and heating the tube at an upper portion thereof, and light component openings and heavy component openings leading radially outwardly from the basket being located at a radius larger than the radius of the inlet at the base of the tube and successively larger than each other with the tube in one form having a ceramic mouth at the base and a collar insert, and in one form, flaring radially outwardly in an upward direction.

16 Claims, 3 Drawing Figures

APPARATUS FOR THE SEPARATION OF A MIXTURE OF COMPONENTS, PARTICULARLY MOLTEN METALS, METAL COMPOUNDS AND/OR METAL CONTAINING SLAGS IN A CENTRIFUGAL FORCE FIELD

BACKGROUND OF THE INVENTION

The present invention relates to an apparatus for the separation of a mixture of components, and more particularly to an improved centrifugal separator for separating molten metals, metal components or metal containing slags by centrifugal forces.

Centrifuges for separating phases of metal or metal compounds or metal and slags have been heretofore used wherein the centrifuge body was suspended by universal joint and driven in rotation. An example of such a metal centrifuge is disclosed in the German Laid-Open Specification No. 25 18 796, and in this structure, the charging material is introduced from above through a stationary charging hopper projecting into the interior of a rotating hollow shaft forming the centrifuging body. The liquid or molten metal such as a molten slag is deflected through a corotating deflecting apparatus to all areas of the centrifugal container and simultaneously accelerated in the direction of rotation. Discharge openings are located in the lower end of the centrifuge body for separated materials, and the body is bell shaped. In a metal centrifuge of this known type, difficulties are encountered in the presence of the necessity of absolutely uniform charging of the material into the separator. The liquid metal slag mixture must be poured, for example, out of a pouring ladle from above. In addition to the difficulty of uniform pouring from a ladle, the material encounters too high inertia in being deposited from above engaging the deflection apparatus in the interior of the centrifuge body with too high inertia.

Further, in this type of device, it is necessary to line the centrifuge, particularly in the discharge area, with a gas-tight material, or at least to provide a drive or barrier of inert or reducing gas to prevent a reoxidation of the centrifuged out hot metal particles. It is accordingly an object of the present invention to provide a mechanism for a metallurgical plant which is capable of centrifugally separating metals without the aid of special charging apparatus or complicating charging methods and to make possible the provision of a centrifuge which may be partially immersed in a bath of liquid metal or metal slag mixtures such as, for example, in an available casting or pouring ladle and to thereby adapt the centrifuge to the particular operating conditions present in existing metallurgical plants without the provision of special additional equipment.

The foregoing object is accomplished by a feature of the invention wherein the centrifugal body is provided at its lower area with a concentric aperture that is immersed below the liquid level of the material to be separated, and has provided in its upper area openings for centrifuging off of the separated components. The spacing of the openings for centrifuging off the separated components is greater than the radius of the concentric submerged opening. With this arrangement, the apparatus accomplishes a continual upward flow of layers of material being separated. In a preferred embodiment of the apparatus, the centrifugal body has a central hollow shaft with the lower area of the centrifugal body constructed as an immersion pipe. In a further preferred arrangement, the hollow shaft at least in the area of the immersion pipe is enclosed by a cooling sleeve constructed for conducting a cooling fluid. The apparatus further has a supporting basket surrounding the hollow shaft and being of larger diameter and carrying the centrifugal body. The supporting basket is also preferably enclosed by the cooling sleeve. The cooling sleeve is so constructed so that it is connected to inlet and outlet conduits for conducting a cooling medium. The immersion pipe is connected with the interior of the centrifugal body by means of radially extending conduits. The cooling medium flows to surround the immersion pipe of the sleeve and absorb heat in the immersed area and transfer the heat back, at least in part, to the wall areas of the centrifugal body contacted by the centrifuged material. This prevents deposits on the wall of the unit.

In one alternate arrangement of the structure, the centrifugal body is constructed in a frusto-conical shape with the body widening in an upward direction. The opening at the base of the centrifugal body has a collar recessed axially inwardly and additionally may have a flow conducting body therein. Both the collar as well as the flow conducting body effect a suction on the material in which the lower end is submerged to increase the flow into the chamber in which the material is centrifuged.

In consideration of the high stresses on the entry location of the centrifuge, the centrifugal body may be provided in the immersed area with a mouth piece made of a heat resistant, corrosion resistant and abrasion resistant material, such as, ceramic. Such a mouth piece may be constructed of a graphite casting or a blank or a molded body made of sintered resistant metal oxide or other material having similar physical properties.

In one embodiment the centrifugal body is provided with a plurality of layers wherein the inner layer is formed of a heat and corrosion resistant material and the inner layer is enclosed by an outwardly located insulating and supporting layer which is supported against an outer sleeve to receive and sustain radial forces.

Other objects, advantages and features, as well as alternate embodiments and structures which are intended to be covered herein, will become more apparent with a teaching of the principles of the invention in connection with the disclosure of the preferred embodiments in the specification, claims and drawings, in which:

DRAWINGS

DESCRIPTION

Figure 1:
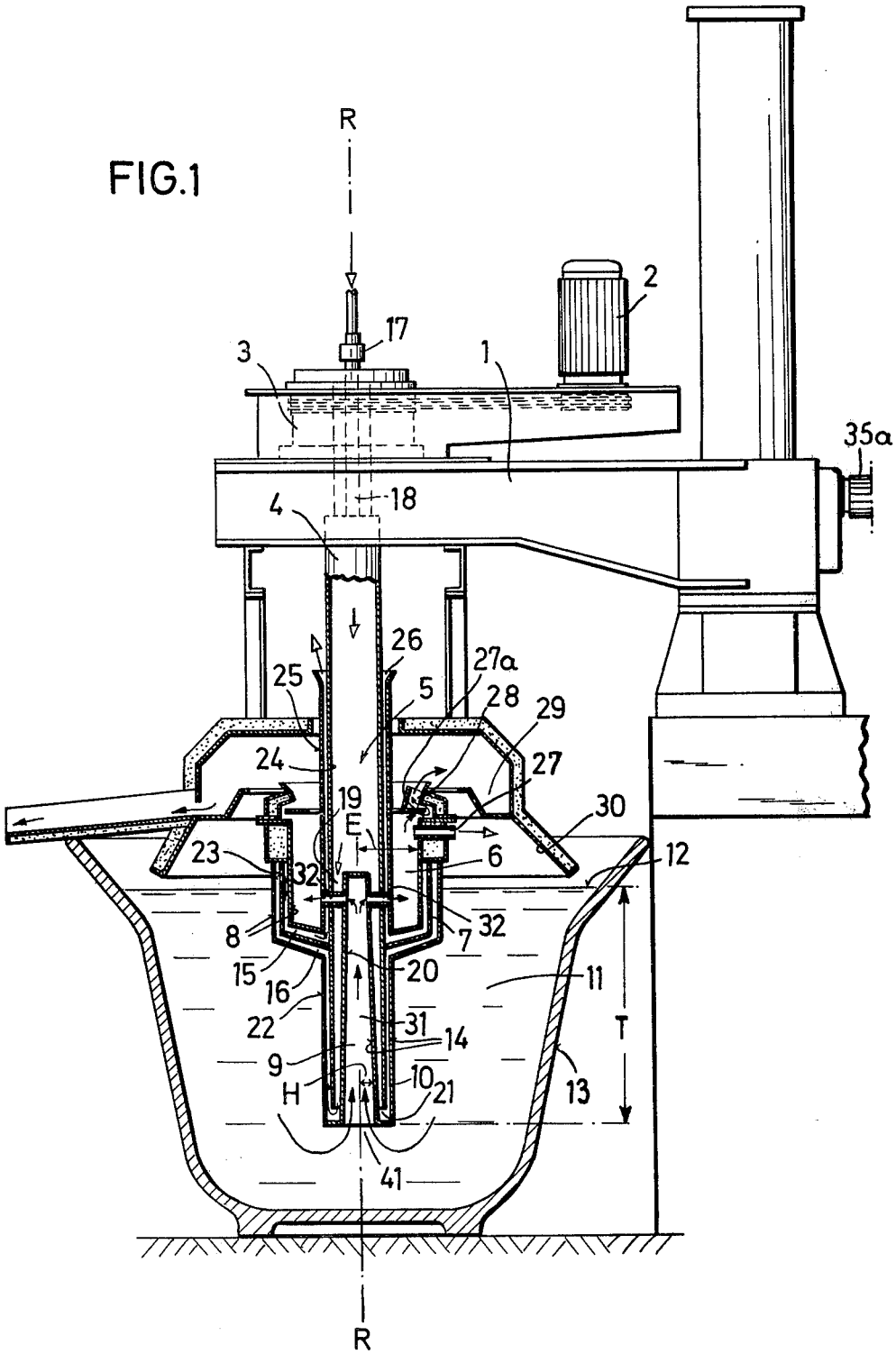
FIG. 1 is a vertical sectional view, shown somewhat in schematic form, of a centrifuge constructed and operating in accordance with the principles of the present invention.

As illustrated in FIG. 1, a vertically and horizontally adjustable arm supports a drive 2 and also supports the universal suspension and bearing 3 of a hollow shaft 4 for a centrifuge 5.

The overall rotatable portion of the centrifuge is designated as a centrifugal body 6 which is formed of a heat proof, corrosion resistant material resistant to abrasion. The centrifugal body incorporates the hollow vertical shaft 4 which has a larger supporting basket 7 at an intermediate location carried by the hollow shaft and which is constructed in the form of a double chambered concentric annular cooling sleeve. The lower end of the hollow shaft, as indicated at the area 9, is formed as an immersion pipe 10. The lower end or immersion pipe 10 has a concentric opening 41 at its lower end which is submerged in a metal bath 11 below the level of the level 12 of the bath. The molten metal bath is located, for example, in a casting or pouring ladle 13, and the bath may consist of a mixture of material such as 98.5% slag and 1.5% metal. This, however, is only one example of a wide range of utilization of the structure as will be apparent to those versed in the art from the description contained herein.

The lower area 9 of the hollow shaft 4 forms an immersion pipe 10 and the immersion pipe 10 is enclosed by a dual annular chambered cooling sleeve 14. The lower cooling sleeve 14 communicates with the upper sleeve 8 for the basket through intermediate spaces 15 and 16 so that the dual chambers of the cooling sleeves for the lower and upper end communicate for the flow of a cooling medium.

In the present instance, air is used as a cooling medium and is delivered from an air pressure source R through a conduit 17 into a bore 18 in the upper part of the hollow shaft 4. The cooling air flows downwardly into the space 19 (as indicated by the arrowed line) between the inner cooling sleeve part 20 and the hollow shaft 4. At the lower end 21 of the hollow shaft 4, the cooling fluid flows outwardly and upwardly through the intermediate flow portion 16 between the outer cooling sleeve 22 and the hollow shaft 4, and flows upwardly surrounding the basket 7 and passes through openings 23 in the periphery of the supporting basket 7 into the inner cooling chamber surrounding the basket and down through the intermediate chamber 15 formed between the cooling sleeve 8 and the supporting basket 7. The air flows downwardly and then upwardly on the inner wall areas of the centrifugal body 6 between the hollow shaft 4 and the cooling sleeve 25, and at location 26 as indicated by the arrowed line, the air flows out of the cooling system.

With respect to the flow of cooling air, the air entering at the point 19 in its downward path and around the lower end 21 the hollow shaft 4 and upwardly toward the openings 23, is heated in the areas of the cooling sleeve 14 due to transfer of heat from the metal bath 11. The heated cooling air thus acts as a heat transfer medium. The heated air gives off heat to the inner wall area of the centrifugal body 6 and heats the wall 25. This heat transfer is of significance because it insures that sufficient heat is supplied to the inner wall area of the centrifugal body 6 in order to prevent the formation of rigid crusts. Such crusts can occur when the centrifuge is not rotating and the material is not flowing.

The depth of immersion of the centrifuge into the molten bath 11 is indicated by the double arrowed line and the dimension line T.

As the material from the pouring ladle passes upwardly into the lower opening 41, as indicated by the two curved arrowed lines, the centrifugal action on the material plus the material rising to its own level, causes it to pass laterally out through the openings or conduits 32 which extend substantially radially outwardly. The material flow into the basket and the centrifugal force separates the materials forming light components and heavy components. Radially extending openings 27 lead outwardly from the basket to be deflected against the flared shield 30 back down into the pouring ladle. The heavier components pass out through the flow openings **27*a* as indicated by the arrowed lines and up over the top of a centrifugal collar 28. These materials are collected in the collection gutter 29 and flow out through the lateral spout shown leading from the collection gutter 29**.

A significant factor of construction is the relationship between the radius of the bottom opening 41 and the radial spacing of the light components opening 27 and the radial spacing of the heavy components 28. The radius for the light components opening 27 is greater than the radius of the opening 41, and the radius of the location of the heavy components opening **28*a* is still greater. In other words, the radius of the opening 41, the radius of the light components opening 27 and the radius of the heavy components opening 28** are each successively greater.

In operation the centrifuge 5 which may be mounted, for example, on an under-carriage, not shown, is conveyed and located onto a casting or pouring ladle and with power equipment such as shown at **35*a* is lowered into the pouring ladle 13 with the immersion pipe 10 below the bath level 12 of the molten metal bath 11. Following this operation the centrifuge mechanism is in a position of rest with the power locating mechanism 35*a* being inoperative until the unit is to again be moved. After the unit is placed in its operative depth in the metal bath, compressed air is supplied through the conduit 17 and the cooling compressed air flows annularly down through the area 19 through the previously described path downwardly about the lower end 21 of the hollow shaft through the intermediary chambers 16 and 15 and surrounding the cooling sleeve areas around the lower pipe and around the basket. The air is heated in the area of the immersion pipe 10 and the heat is transferred to the inner walls of the centrifugal body at 6**.

Upon immersion of the centrifuge 5 in the bath, the material to be separated flows upwardly through the concentric opening 41 in the immersion pipe and will rise within the inner chamber 31 to the height of the bath level. The channels 32 which connect to the inner chamber 31 of the immersion pipe 10 flood and the material flows outwardly into the interior of the centrifugal body 6, that is, the basket portion. As previously mentioned, the centrifugal body was heated by virtue of the flow of the cooling medium so that it is at an operational temperature only slightly below the temperature of the metal bath 11. The centrifuge is now driven in rotation by the aid of the drive 2 and separation occurs with the light and heavy phases flowing outwardly as above described.

Control of the quantity and operational flow of material being handled will be possible as will be apparent to those versed in the art. Control can be obtained by control of more or less immersion of the centrifuge into the metal bath by the power mechanism **35*a*. The control or amount of feed also can be influenced by design by alteration of the diameter of the central opening 41, or the openings 27 and 28*a* respectively. Further, in some instances it may be desirable to have the immersion pipe constructed with the interior 31** having a conical tapering from the bottom so that it decreases in diameter in an upward direction which will retard the flow of material upwardly.

Figure 2:
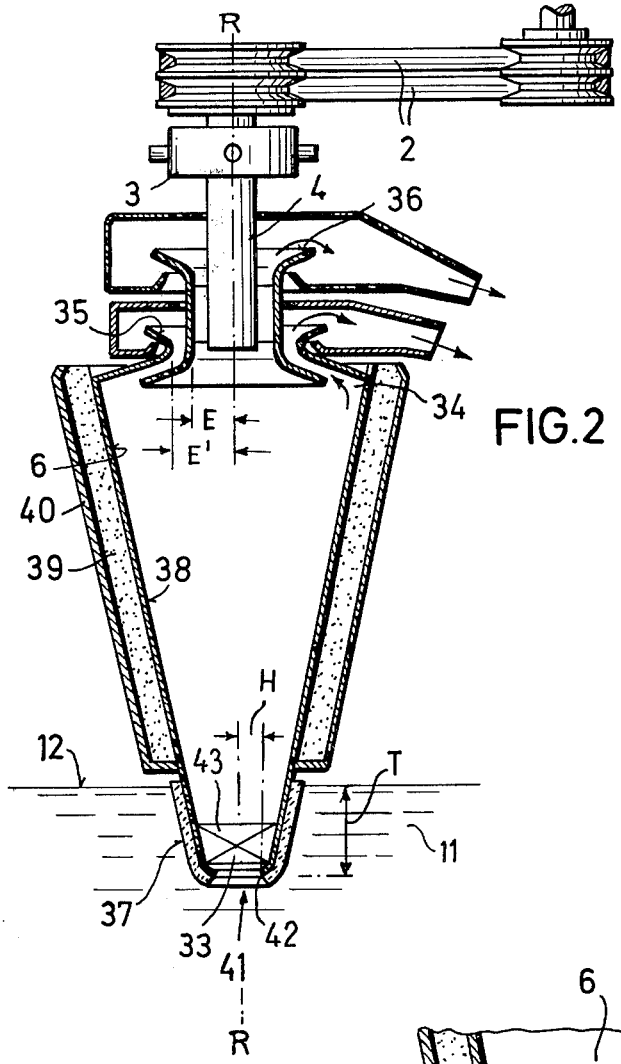
FIG. 2 is a vertical sectional view of another embodiment of a centrifuge, with parts omitted for clarity.

FIG. 2 illustrates another form of the metal centrifuge. In FIG. 2, like parts are provided with like numbers. The centrifugal body 6 of FIG. 2 widens from its lower area in an upward direction so that the lower end at area 33 is smaller than the upper area at 34 with the chamber being frusto-conical in shape. In the lower area 33 is the concentric opening 41 which is immersed in the metal bath 11 a distance T which is substantially less than that in the construction of FIG. 1. In the upper area 34 are positioned two standing collars 35 and 36 which dam up or limit the flow of centrifugal material and which form openings for respectively centrifuging off the heavy and light phases. In the embodiment of FIG. 2, the radial spacing E and E' of the openings 36 and 35 for the light and heavy phases are such that they are progressively larger than the radius H of the opening 41.

The universal bearing 3 and the drive 2 are shown diagrammatically in FIG. 2. A short hollow shaft 4 supportingly suspends the centrifugal body 6. Suitable radial spokes or similar connection mechanism is provided, not shown.

In the lower area 33 of the centrifugal body is an axially recessed collar 42. Also positioned recessed within the opening 41 is a flow rectifier 43 which may be in the form of a piece of sheet metal arranged diagonally in the inlet area. This is positioned within a mouth piece 37 containing the opening 41. The flow rectifier provides a momentum or rotational acceleration means for the material entering the opening and supports the material movement in the lower area 33 as it moves to the upper area 34 against gravity. This requires a relatively small immersion depth T below the bath level 12.

Figure 3:
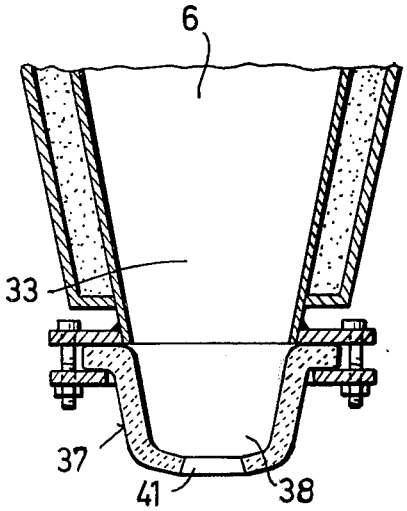
FIG. 3 is an enlarged fragmentary view of the lower part of the centrifuge, in vertical section.

In FIG. 3 the centrifugal body is formed of layers having physical properties of heat resistance, corrosion resistance and abrasion resistance with the inner layer 38 formed of special material having these properties surrounded by an insulating layer 39. The insulating layer 39 is enclosed by a sleeve 40 which functions to support the radial forces of the centrifugal system.

FIG. 3 shows in detail the lower area 33 of the centrifugal body 6. A mouth piece 37 is formed of a molded body 38 formed of a ceramic material. The mouth piece 37 consists of a material having a good capacity of a resistance with respect to the high demands on account of heat effect, corrosion and abrasion. The illustrations show the preferred arrangements and those versed in the art will appreciate modifications within the scope of teachings of the invention. Thus, we have provided a structure which meets the objectives and advantages above set forth and is capable of an operation eliminating difficulties and disadvantages present in structures heretofore available.

We claim as our invention:

1. An apparatus for the separation of components such as molten metals, metal compounds or metal containing slags by centrifugal force, comprising in combination:

a centrifugal body rotatable on a vertical axis forming a separating chamber at its lower end with a lower concentric opening for immersion below the level of a liquid material to be separated;

first and second openings in the upper area of the centrifugal body for receivving separated components, said openings having spacing from the axis of rotation of the body greater than the radius of the concentric opening;

a universal suspension at the upper end of said body with the body depending downwardly therefrom;

and a rotational drive connected to the upper end of said body.

2. An apparatus for the separation of components such as molten metals, metal compounds or metal containing slags by centrifugal force constructed in accordance with claim 1:

wherein the separating chamber of the body is in the form of a central hollow shaft having an annular outer separating wall.

3. An apparatus for the separation of components such as molten metals, metal compounds or metal containing slags by centrifugal force constructed in accordance with claim 2:

wherein the hollow shaft has a lower portion constructed as an immersion pipe supported on the centrifugal body.

4. An apparatus for the separation of components such as molten metals, metal compounds or metal containing slags by centrifugal force comprising in combination:

a centrifugal body forming a separating chamber with a lower concentric opening for immersion below the level of a liquid material to be separated;

and first and second openings in the upper area of the centrifugal body for receiving separated components, said openings having spacing from the axis of rotation of the body greater than the radius of the concentric opening, the separating chamber of the body being in the form of a central hollow shaft having an annular outer separating wall, the hollow shaft having a lower portion constructed as an immersion pipe supported on the centrifugal body and being enclosed at least in the area of said immersion pipe by an annular cooling sleeve.

5. An apparatus for the separation of components such as molten metals, metal compounds or metal containing slags by centrifugal force constructed in accordance with claim 2:

wherein the hollow shaft has a basket at its upper end forming part of the centrifugal body with the basket receiving the flow of separated components through inlets communicating with the hollow shaft.

6. An apparatus for the separation of components such as molten metals, metal compounds or metal containing slags by centrifugal force comprising in combination:

a centrifugal body forming a separating chamber with a lower concentric opening for immersion below the level of a liquid material to be separated;

and first and second openings in the upper area of the centrifugal body for receiving separated components, said openings having spacing from the axis of rotation of the body greater than the radius of the concentric opening, the separating chamber of the body being in the form of a central hollow shaft having an annular outer separating wall and having a basket at its upper end forming part of the centrifugal body with the basket receiving the flow of separated components through inlets communicating with the hollow shaft and said basket being at least partially enclosed by an annular cooling sleeve.

7. An apparatus for the separation of components such as molten metals, metal compounds or metal containing slags by centrifugal force comprising in combination:

a centrifugal body forming a separating chamber with a lower concentric opening for immersion below the level of a liquid material to be separated;

and first and second openings in the upper area of the centrifugal body for receiving separated components, said openings having spacing from the axis of rotation of the body greater than the radius of the concentric opening, the separating chamber of the body being in the form of a central hollow shaft having an annular outer separating wall and the centrifugal body including an annular cooling sleeve for the body and shaft with means for conducting a cooling fluid therethrough.

8. An apparatus for the separation of components such as molten metals, metal compounds or metal containing slags by centrifugal force constructed in accordance with claim 6:

wherein the basket is enclosed by dual layered cooling sleeves having supply and discharge conduits connected thereto for a cooling medium.

9. An apparatus for the separation of components such as molten metals, metal compounds or metal containing slags by centrifugal force constructed in accordance with claim 2:

wherein said shaft has radial conduits leading from the shaft outwardly.

10. An apparatus for the separation of components such as molten metals, metal compounds or metal containing slags by centrifugal force constructed in accordance with claim 9:

wherein the conduits lead approximately radially outwardly.

11. An apparatus for the separation of components such as molten metals, metal compounds or metal containing slags by centrifugal force constructed in accordance with claim 7:

wherein the cooling fluid absorbs heat from the immersed portion of the centrifugal body and transfers heat thus absorbed to the centrifugal body at an area above the immersed portion.

12. An apparatus for the separation of components such as molten metals, metal compounds of metal containing slags by centrifugal force constructed in accordance with claim 1:

wherein said centrifugal body has a portion widening in dimension in an upward direction.

13. An apparatus for the separation of components such as molten metals, metal compounds or metal containing slags by centrifugal force constructed in accordance with claim 1:

wherein a collar is located in said concentric opening spaced axially inwardly therefrom.

14. An apparatus for the separation of components such as molten metals, metal compounds or metal containing slags by centrifugal force constructed in accordance with claim 1:

including a flow conducting body mounted within said concentric opening.

15. An apparatus for the separation of components such as molten metals, metal compounds or metal containing slags by centrifugal force constructed in accordance with claim 1:

wherein said centrifugal body includes an inner layer of heat and corrosion resistant material and is enclosed by an annular outer layer of insulating supporting material supported against an outer sleeve absorbing radial forces.

16. An apparatus for the separation of components such as molten metals, metal compounds or metal containing slags by centrifugal force comprising in combination:

a rotatable vertical chamber having an annular surrounding wall with an axial inlet opening of a predetermined radius at the lower end to be submerged beneath the surface of a molten liquid to be separated with the liquid being drawn up by centrifugal force into the chamber against said wall;

a first light components circular opening communicating radially with said chamber at a first radius;

and a second heavy components circular opening communicating radically with said inner chamber at a second radius, said openings being coaxial and the radius of the axial inlet opening and said first and second radiuses being progressively larger than each other.

* * * * *